US007430816B1

(12) United States Patent
Lozenski

(10) Patent No.: US 7,430,816 B1
(45) Date of Patent: Oct. 7, 2008

(54) FOOTWEAR DRYER AND SANITIZER APPARATUS

(76) Inventor: Matthew J. Lozenski, 27809 207th St., Easton, KS (US) 66020

( * ) Notice: Subject to any disclaimer, the term of this patent is extended or adjusted under 35 U.S.C. 154(b) by 224 days.

(21) Appl. No.: 11/463,504

(22) Filed: Aug. 9, 2006

(51) Int. Cl.
*F26B 19/00* (2006.01)

(52) U.S. Cl. ..... 34/104

(58) Field of Classification Search ..... 34/104
See application file for complete search history.

(56) References Cited

U.S. PATENT DOCUMENTS 3,632,963 A 1/1972 Bosse
4,198,765 A * 4/1980 Miyamae ..... 34/104
4,774,769 A 10/1988 Dollst
5,592,750 A * 1/1997 Eichten ..... 34/104
5,836,087 A 11/1998 Wilson et al.
2005/0204579 A1* 9/2005 Rosseau et al. ..... 34/104

* cited by examiner

*Primary Examiner*—S. Gravini
(74) *Attorney, Agent, or Firm*—Crossley Patent Law; Mark Ashley Crossley

(57) ABSTRACT

A footwear dryer and sanitizer apparatus comprising a base with upwardly extended, removable, hollow tubes. The top of each tube is removably fitted with a footwear holder, each holder fitted with at least one ultraviolet bulb for sanitation of footwear. The apparatus further comprises a controller for regulating the removable bulbs, heating elements, and fans, such that forced drying air for footwear is warmed. The apparatus supports and holds a pair of footwear for drainage and drying and sanitation, without the need for chemicals or solutions.

8 Claims, 3 Drawing Sheets

FOOTWEAR DRYER AND SANITIZER APPARATUS

BACKGROUND OF THE INVENTION

Footwear is typically in need of drying and often sanitizing due to the very nature of footwear and the human foot. Footwear items include shoes and boots. While drying footwear can be done without forced air, forced air is faster and more effective. Footwear sanitization is not accomplished by drying alone. It is desirable to introduce some form of sanitization which is bactericidal, fungicidal, and kills other undesirable microorganisms. Additionally, footwear is best dried in an inverted position so that heavy moisture is allowed to drain. The present apparatus offers a unique solution to all of these footwear drying and sanitizing needs.

FIELD OF THE INVENTION

The footwear dryer and sanitizer apparatus relates to devices for drying and sanitizing footwear and more especially to a device which supports a pair of footwear in an inverted position, and both dries and sanitizes each footwear item without chemicals or solutions.

DESCRIPTION OF THE PRIOR ART

Various devices exist in the prior art to aid in drying footwear. None offer the advantages of the present apparatus. Prior related art U.S. Pat. No. 5,836,087 issued to Wilson et al. on Nov. 17, 1998 teaches a footwear dryer support rod that includes an interconnectable rod assembly including a fixed length rod section, a circuit housing rod section, and a spring loaded telescoping rod section. The device provides support during the drying of footwear. The device does not feature UV light or powered, warm air flow of the present apparatus. U.S. Pat. No. 4,774,769 issued to Dollst on Oct. 4, 1988 teaches an apparatus for drying and/or warming shoes. Unlike the ultraviolet light of the present apparatus, the device employs a receptacle for holding a disinfectant. U.S. Pat. No. 3,632,963 issued to Bosse on Jan. 4, 1972 teaches a footwear-heating mold for insertion inside a shoe or boot. The device does not offer forced air or ultraviolet functions of the present apparatus.

While the above-described devices fulfill their respective and particular objects and requirements, they do not describe a footwear dryer and sanitizer apparatus that provides for the advantages of the footwear dryer and sanitizer apparatus. In this respect, the footwear dryer and sanitizer apparatus substantially departs from the conventional concepts and designs of the prior art. Therefore, a need exists for an improved footwear dryer and sanitizer apparatus.

SUMMARY OF THE INVENTION

The general purpose of the footwear dryer and sanitizer apparatus, described subsequently in greater detail, is to provide a footwear dryer and sanitizer apparatus which has many novel features that result in an improved footwear dryer and sanitizer apparatus which is not anticipated, rendered obvious, suggested, or even implied by prior art, either alone or in combination thereof.

To attain this, the footwear dryer and sanitizer apparatus comprises a base from which are extended two spaced apart sets of upwardly rising tubes. The tubes are removable from the base. Further, each set of tubes is comprised of two tubes which are separable. A grate is disposed proximal to the top of the lower tube, to catch any debris which might fall from the footwear to be dried, preventing debris invasion into the lower tube, heating element, and fan of the apparatus. The grate is replaceable. Other replaceable components of the apparatus include the footwear holders, ultraviolet bulbs, heating elements, fans, and controller, thereby providing serviceability of the apparatus.

Each set of tubes provides for fit of the footwear holder in the top of each upper tube. Footwear holders are removable. Due to the relative thickness of the footwear holders in comparison to the diameter of the upper tube air outlets, air easily flows past the footwear holders and into and out of boots and shoes and other forms of footwear. Air cycles through the air intake of the base, through the tubes, and past the footwear holders into the footwear. The air is warmed by the heating elements placed proximal to the bottom end of each lower tube. Preferably, a fan is disposed just below each heating element. The air intake of the base is proximal to the fans for best air flow. The controller regulates temperature of the heating elements. The controller further regulates fan power.

Alternate embodiments of the apparatus are equipped with single fans within the base. Still other embodiments position a single fan within the base.

The ability to disassemble the tubes and the removal capability of the components of the apparatus provide for ease of cleaning and for component replacement.

Thus has been broadly outlined the more important features of the improved footwear dryer and sanitizer apparatus so that the detailed description thereof that follows may be better understood and in order that the present contribution to the art may be better appreciated.

An object of the footwear dryer and sanitizer apparatus is to dry a pair of footwear simultaneously.

Another object of the footwear dryer and sanitizer apparatus is to dry footwear in an inverted position.

A further object of the footwear dryer and sanitizer apparatus is to use warmed air for drying.

An added object of the footwear dryer and sanitizer apparatus is to sanitize footwear.

And, an object of the footwear dryer and sanitizer apparatus is to sanitize footwear without chemicals or solutions.

These together with additional objects, features and advantages of the improved footwear dryer and sanitizer apparatus will be readily apparent to those of ordinary skill in the art upon reading the following detailed description of presently preferred, but nonetheless illustrative, embodiments of the improved footwear dryer and sanitizer apparatus when taken in conjunction with the accompanying drawings.

In this respect, before explaining the current embodiments of the improved footwear dryer and sanitizer apparatus in detail, it is to be understood that the footwear dryer and sanitizer apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved footwear dryer and sanitizer apparatus. It is therefore important that the claims be regarded as including such equivalent constructions insofar as they do not depart from the spirit and scope of the footwear dryer and sanitizer apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the footwear dryer and sanitizer apparatus generally designated by the reference number 10 will be described.

Figure 1:
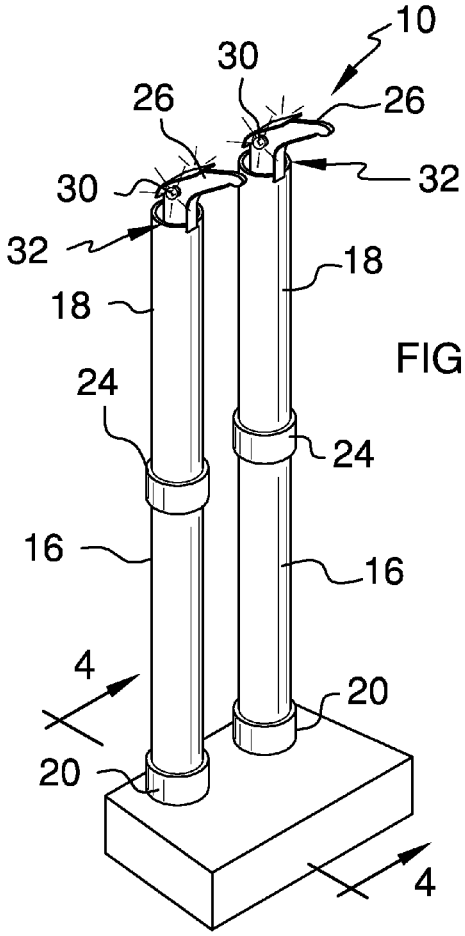
FIG. 1 is a perspective view.
Figure 2:
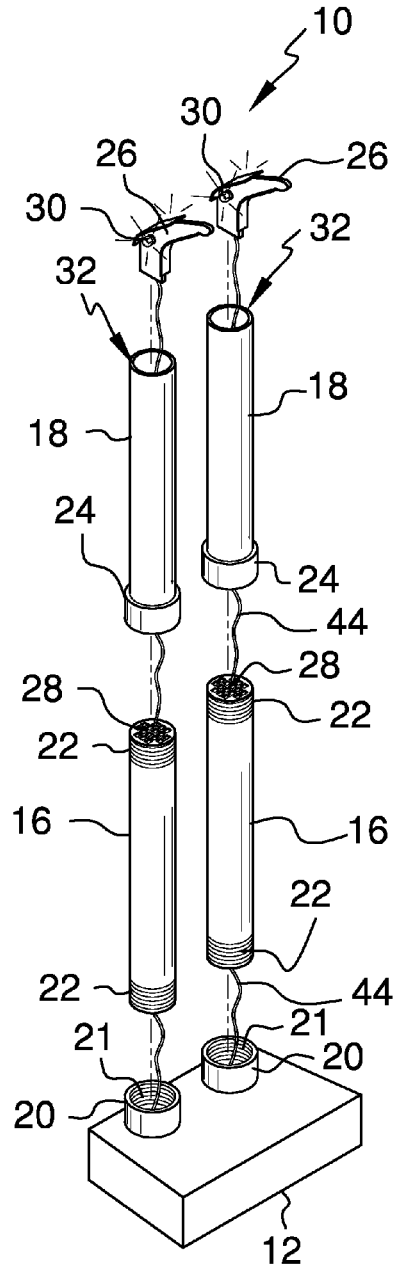
FIG. 2 is an exploded perspective view.

Referring to FIGS. 1 and 2, the footwear dryer and sanitizer apparatus 10 comprises a parallelepiped base 12. A pair of spaced apart bottom collars 20 is disposed in the top of the base 12. Each bottom collar 20 is further comprised of a female thread 21 within. A pair of hollow lower tubes 16 is provided. Each lower tube 16 has a first end, a second end, and a length therebetween. A male thread 22 is provided on each of the lower tube 16 ends. The male thread 22 of each first end of each lower tube 16 is removably fitted within the female thread 21 of one of the bottom collars 20, respectively. A pair of upper tubes 18 is provided. Each upper tube 18 has a first end, a second end, and a length therebetween. An upper collar 24 is disposed on the first end of each upper tube 18. A female thread (not shown) is disposed within each upper collar 24. Each upper collar 24 thereby removably fits to each lower tube 16 second end male thread 22. An air outlet 32 is disposed in the second end of each hollow upper tube 18. A footwear holder 26 is removably fitted within a portion of each upper tube 18 air outlet 32. Each footwear holder 26 supports a footwear item 60, FIG. 5, in an inverted position. Inverted positioning of a footwear item 60 enables more effective water drainage from extremely wet footwear items 60. Outlet air travels past each footwear holder 26. In the illustrated embodiment of the apparatus 10, an ultraviolet bulb 30 is preferably disposed on each side of each footwear holder 26. Each ultraviolet bulb 30 is controlled by the controllers 42. Further embodiments of the apparatus 10 may comprise more or fewer ultraviolet bulbs 30. Electrical wires 44 connect the electrical components of the apparatus 10. Each lower tube 16 is further comprised of a grate 28. Each grate 28 is positioned proximal to the second end of each lower tube 16. Each grate 28 provides that any items of size which may fall from footwear 60 when inverted do not pass into the lower tubes 16.

Figure 3:
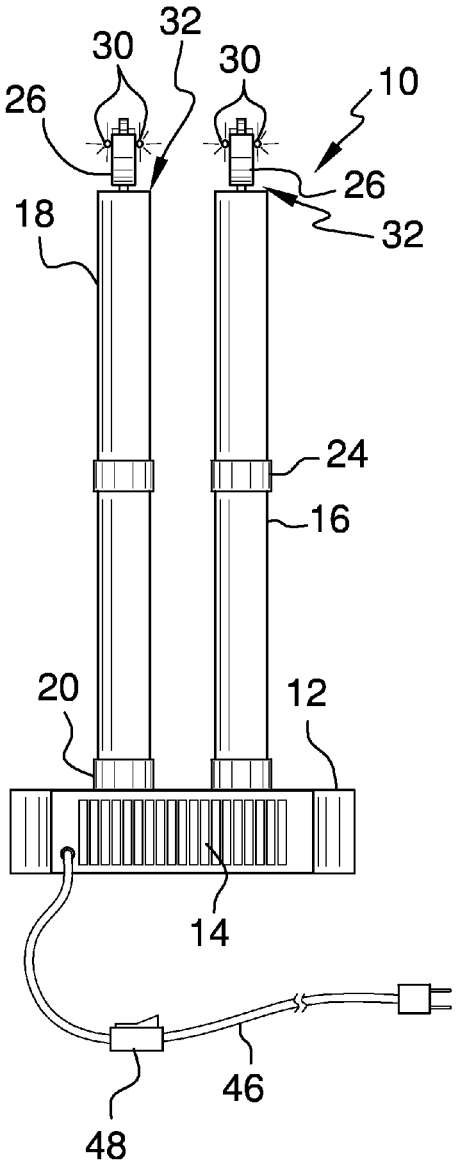
FIG. 3 is a front elevation view.

Referring to FIG. 3, the back elevation view defines the air intake 14 of the base 12. The powercord 46 supplies electrical power from standard electrical outlets. The switch 48 provides on/off control of the apparatus 10. The relative thickness of each footwear holder 26 with respect to each upper tube 18 diameter provides for plentiful air flow around and past each footwear holder 26. Air flows into the air intake 14 and out each air outlet 32 of each upper tube 18.

Figure 4:
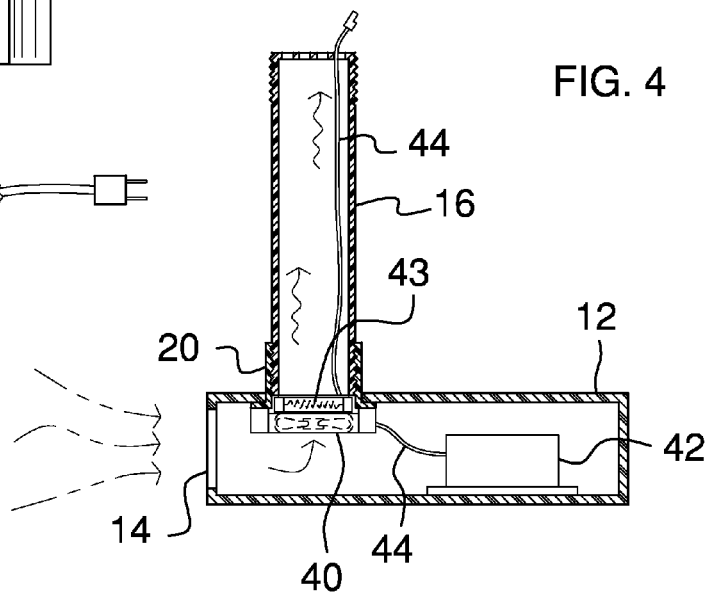
FIG. 4 is partial cross sectional view of FIG. 1, taken along the line 4-4.

Referring to FIG. 4, an electrically powered fan 40 is disposed within the base 12 below each bottom collar 20. In further embodiments, a single fan 40 is used to provide air flow through both sets of upper tubes 18 and lower tubes 16. A pair of heating elements 43 is disposed within the base 12. Each heating element 43 is disposed within one of the bottom collars 20. Each heating element 43 is disposed between the fan 40 and one of the lower tubes 16. The controller 42 is disposed within the base 12. The controller 42 controls the heating elements 43 and the fans 40. The controller 42 further controls the ultraviolet bulbs 30.

Figure 5:
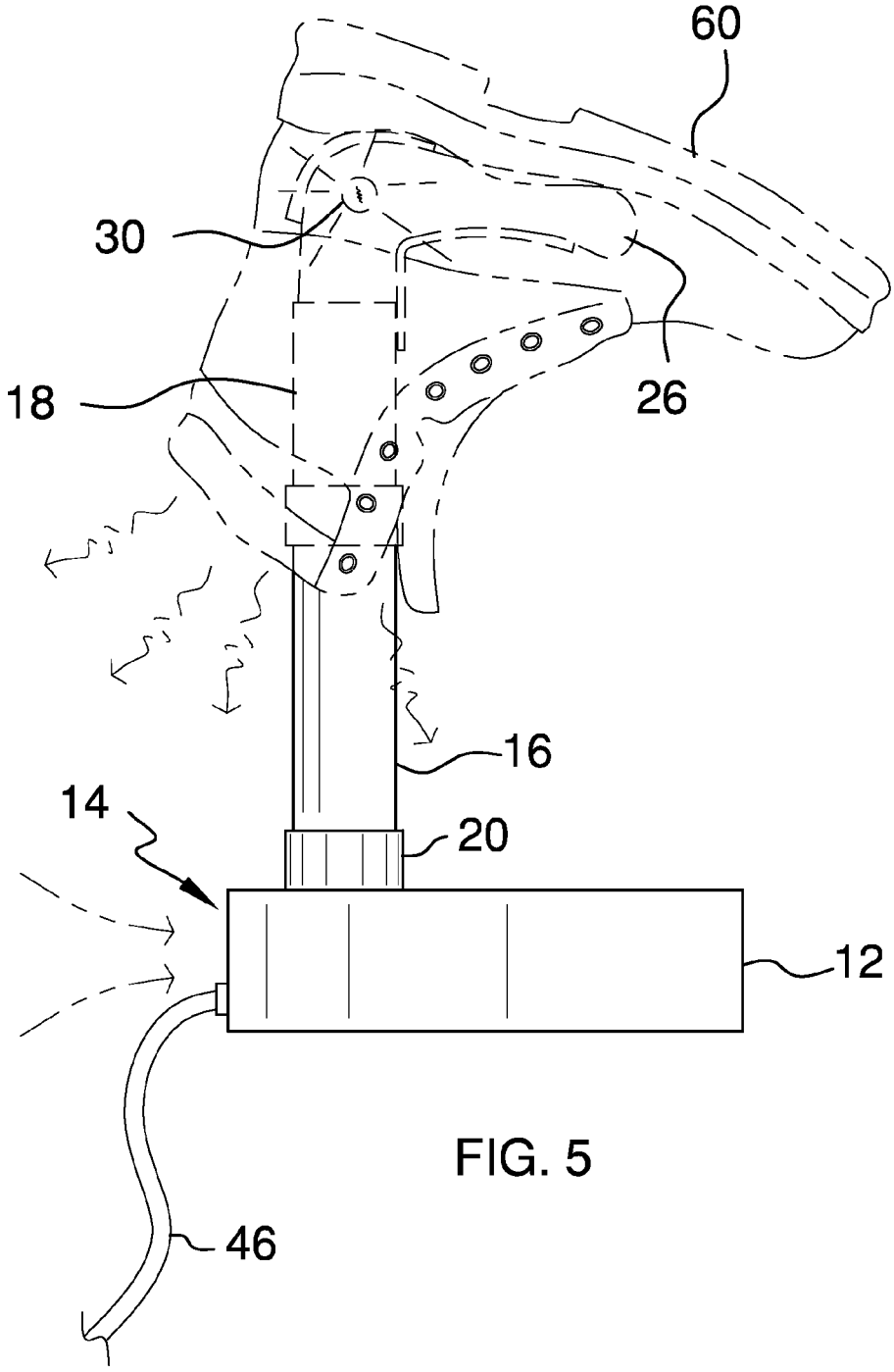
FIG. 5 is a side elevation view of the apparatus in use with a boot.

Referring also to FIG. 5, the air intake 14 is disposed in the back side of the base 12. The bottom collars 20 are disposed proximal to the back side of the base 12. The air intake 14 being proximal to the fans 40 thereby effectively provides air to the fans 40. The base 12 offers sufficient width and depth to support footwear 60 for effective drying, preventing the toppling of the apparatus 10, even when fitted with footwear 60. Ideally, the apparatus is about 24 inches high, 10 inches wide, and 10 inches deep. Elevation of footwear 60 above a floor or other surface further aids in air flow and subsequent drying of footwear 60. The ultraviolet bulbs 30 are proven bactericidal, fungicidal, and are proven as lethal to other forms of algae, mold, and other causes of footwear 60 odor.

With respect to the above description then, it is to be realized that the optimum dimensional relationships for the parts of the footwear dryer and sanitizer apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the footwear dryer and sanitizer apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the footwear dryer and sanitizer apparatus may be used.

Therefore, the foregoing is considered as illustrative only of the principles of the footwear dryer and sanitizer apparatus. Further, since numerous modifications and changes will readily occur to those skilled in the art, it is not desired to limit the footwear dryer and sanitizer apparatus to the exact construction and operation shown and described, and accordingly, all suitable modifications and equivalents may be resorted to, falling within the scope of the footwear dryer and sanitizer apparatus.

What is claimed is:

1. A footwear dryer and sanitizer apparatus, comprising:

a parallelepiped base;

an air intake within the base;

a pair of spaced apart bottom collars in a top of the base;

an electrically powered fan disposed below each bottom collar;

a female thread within each bottom collar;

a pair of hollow lower tubes, each lower tube having a first end, a second end, and a length therebetween;

a male thread on each of the lower tube ends, the male thread of each first end removably fitted within the female thread of one of the bottom collars, respectively;

a pair of upper tubes, each upper tube having a first end, a second end, and a length therebetween;

a female threaded upper collar on the first end of each upper tube, each upper collar thereby removably fitted to each lower tube second end male thread;

an air outlet in the second end of each upper tube;

a pair of heating elements within the base, each heating element within one of the bottom collars, each heating element between the fan and the tubes;

a controller for controlling the heating elements and the fans;

a power source for the controller;

a switch for the power source;

an air outlet in each tube;

a footwear holder fitted within a portion of each upper tube air outlet, whereby outlet air travels past each footwear holder;

at least one removable ultraviolet bulb on each footwear holder, each ultraviolet bulb controlled by the controller.

2. The apparatus in claim 1 wherein each footwear holder supports a footwear item in an inverted position.

3. The apparatus in claim 1 wherein each lower tube is further comprised of a grate, each grate positioned proximal to the second end of each lower tube.

4. The apparatus in claim 2 wherein each lower tube is further comprised of a grate, each grate positioned proximal to the second end of each lower tube.

5. The apparatus in claim 1 wherein each footwear holder is removable.

6. The apparatus in claim 2 wherein each footwear holder is removable.

7. The apparatus in claim 3 wherein each footwear holder is removable.

8. The apparatus in claim 4 wherein each footwear holder is removable.

* * * * *